United States Patent [19]

Kramer

[11] Patent Number: 4,530,215

[45] Date of Patent: Jul. 23, 1985

[54] REFRIGERATION COMPRESSOR WITH PUMP ACTUATED OIL RETURN

[76] Inventor: Daniel E. Kramer, 2009 Woodland Dr., Yardley, Pa. 19067

[21] Appl. No.: 523,616

[22] Filed: Aug. 16, 1983

[51] Int. Cl.[3] ..... F25B 43/02

[52] U.S. Cl. ..... 62/84; 62/468

[58] Field of Search ..... 62/468, 469, 470, 84

[56] References Cited

U.S. PATENT DOCUMENTS

| | | | |
|---|---|---|---|
| 3,140,041 | 7/1964 | Kramer et al. | 62/84 |
| 3,280,576 | 10/1966 | Endress | 62/84 |
| 3,304,741 | 2/1967 | Weller | 62/471 |
| 3,379,033 | 4/1968 | Grant | 62/84 |
| 3,500,962 | 3/1970 | Kocher | 62/468 |
| 3,636,723 | 1/1972 | Kramer | 62/197 |
| 3,792,594 | 2/1974 | Kramer | 62/503 |
| 3,866,438 | 2/1975 | Endress | 62/468 |
| 4,213,307 | 7/1980 | Watson | 62/468 |
| 4,275,570 | 6/1981 | Szymaszek et al. | 62/468 |

OTHER PUBLICATIONS

Dossat, Roy J.: Principles of Refrigeration, pp. 358–360.

*Primary Examiner*—Ronald C. Capossela

*Attorney, Agent, or Firm*—Daniel E. Kramer

[57] ABSTRACT

A compressor having an oil sump, an external oil reservoir, a conduit connecting the bottom of the oil reservoir to the compressor sump, a pump in the conduit for pumping excess oil from the reservoir to the compressor sump, and an overspill from the compressor sump back to the oil reservoir and a high side or a low side oil separator for removing oil from the refrigerant flow stream and returning it to the reservoir.

23 Claims, 7 Drawing Figures

REFRIGERATION COMPRESSOR WITH PUMP ACTUATED OIL RETURN

BACKGROUND OF THE INVENTION

1. Field of the Invention

The invention is in the field of mechanical refrigeration and more particularly relates to refrigeration compressors having an oil sump. The invention further relates to means for providing a reservoir external to the compressor when the refrigeration system is of the sort that the amount of oil it holds in circulation is a variable, so that at one time a great deal of oil might be in circulation and at another time only a small amount of oil would be in circulation.

The invention further relates to the application of a pump to withdraw oil from the reservoir and deliver it in excess quantity to the compressor sump and further relates to the application of an overspill conduit from the compressor pump back to the oil reservoir so that the unneeded excess of oil delivered to the compressor sump by the pump will simply flow by gravity back into the reservoir.

The invention further relates to the use of a high side or a low side separator to remove oil from the flowing refrigerant and to return it directly or indirectly to the oil reservoir.

2. Description of the Prior Art

There is available an oil return system at present manufactured by the AC&R Company and by the Sporlan Valve Company which utilizes a high side oil separator installed in the compressor discharge line. The separated oil is delivered to a storage reservoir which is maintained at a pressure about 15 psi above suction pressure by a pressure differential regulating valve. The flow of oil to the compressor is adjusted by a float mounted on the side of the compressor. The float senses the level of the oil within the compressor sump. When the oil level is higher than the float setting, the float closes the oil supply valve and no flow from the oil reservoir to the sump can occur. When the oil level in the compressor sump is lower than the float setting, the valve, governed by the position of the float, opens, and the oil flows into the compressor sump from the pressurized oil reservoir.

SUMMARY OF THE INVENTION

Reciprocating compressors are generally fabricated with an upper portion containing the cylinders and the pistons, an intermediate portion containing the crankshaft and an oil pump, and a lower portion containing the oil sump. The oil sump generally includes a window or sightglass on the side of the compressor housing so that an observer can tell whether the oil level is too high or too low. All commercially manufactured refrigeration compressors "pump" some oil. The term "pumping oil" refers to the entrainment in the refrigerant flow stream of some of the oil in the compressor crankcase. This oil is circulated through the refrigeration system with the circulating refrigerant and generally returns to the compressor along with the suction vapors. Generally the compressor is designed so that a separation process occurs at its inlet and means in the compressor are provided for incoming oil to drain back into the compressor sump.

Some kinds of refrigeration systems, such as flooded systems or large, direct expansion evaporators, have the characteristic that they can retain relatively large quantities of oil at one time and relatively smaller quantities of oil at another time. Direct expansion evaporators, which are fully flooded with refrigerant, hold little oil. By contrast, the same evaporator operated "starved" or less than fully flooded, will hold and retain much oil. An example of such a situation is provided by a direct expansion evaporator which may utilize a thermal expansion valve with a pressure limit. This is an expansion valve which floods the evaporator, unless the flooding of the evaporator would cause the suction pressure to rise above a preset limit, at which time it starves the evaporator while maintaining the suction pressure at or below the preset limit. During pulldown conditions, when the box is warm, the expansion valve will operate on the pressure limit and the evaporator will be seriously starved. Under these conditions, the evaporator will retain a large quantity of oil. When the box comes down to temperature and the expansion valve more nearly fully floods the evaporator, much of the oil retained in the starved evaporator will be released and will return to the compressor.

If the difference between the maximum quantity of oil that can be retained in the evaporator and the smallest quantity of oil that can be retained in the evaporator is greater than the difference between the minimum quantity of oil with which the compressor can operate and the largest quantity of oil with which the compressor can operate, then we will have the situation either where the compressor will run out of oil and be stopped by its oil failure switch when the maximum quantity of oil is held by the evaporator, or that the compressor will be overfilled with oil leading to excessive oil pumping, compressor destruction by slugging, oil foaming, or excessive motor loading caused by the throws of the connecting rods churning through the pool of oil in the sump itself.

Further, service personnel have been trained to believe that they should always find the oil level in the compressor midway between the upper and lower limits of the oil sightglass. Frequently, when they see no oil in the sightglass, even though the compressor is operating normally, they will add oil, causing a condition of excess oil when the oil temporarily lodged in the lowside returns.

Therefore, it is an object of this invention to provide an external reservoir for oil, separate from the compressor sump but at the same pressure, whose oil level may raise and lower depending on the oil holding condition of the remainder of the system. A level gauge is installed in the oil reservoir so that an observer will be able to tell whether the reservoir is completely full, or half full, or nearly empty.

The invention further requires a conduit from a low point in the oil reservoir to some point in the compressor This point may be above, below or at the normal oil level. In order to cause flow from the reservoir, which is located below the compressor itself, to the compressor sump, a pump is provided in the conduit for pumping oil from the reservoir to the compressor. The pump is selected so that considerably more oil is pumped to the compressor sump than could conceivably ever be used by it. Therefore, an excess of oil is always being fed to the compressor sump from the reservoir by way of the oil pump. The pump may be integral with the compressor and powered by the compressor motor or separate from the compressor. The pump may have the function of providing oil under pressure to the compressor bearings as well as transferring oil from the reservoir to the compressor sump.

An overflow conduit is provided from the compressor sump back to the oil reservoir. This overflow conduit ensures that excess oil delivered to the compressor sump from the reservoir by the oil pump does not accumulate in the oil sump causing the above mentioned difficulties, but drains so that the oil level in the compressor sump is always at or slightly above the level of the overflow conduit.

When the external portion of the system, such as the evaporator, requires or retains a large quantity of oil, the oil level in the compressor does not change at all. Only the oil level in the reservoir changes by dropping. When the evaporator or other system portion retains only a little oil, the oil level in the compressor does not rise because excessive oil automatically drains back to the reservoir. Instead, only the level of oil in the oil reservoir rises and though the range of oil from the lowest level in the reservoir to the highest level may be many times more than the compressor sump could handle without running out of oil or damaging the compressor, the reservoir itself handles this large change in oil quantity readily because it is designed to do so.

There are three ways that oil can be returned to the oil reservoir. One is by allowing the compressor to perform its normal job of separating oil which returns through the suction line along with the suction vapor from that suction vapor and delivering the oil to the compressor sump. Excess oil will simply overflow into the oil reservoir.

Second is through the use of a discharge line oil separator. This oil separator has an internal float assembly which rises as oil accumulates, opens a small port and allows the oil to flow to an area of lower pressure, in this case the oil reservoir. High pressure vapors dissolved in the oil are simply vented back to the compressor sump through the overflow conduits.

Third is through the use of a suction line oil separator which is also known as a suction accumulator. This device is an enlargement in the suction line and in the version preferred for use with this invention has a fitting at the bottom of the enlargement whereby oil separated from the flowing suction vapor is returned by gravity to a conduit connecting the fitting on the bottom of the enlargement or tank and the oil reservoir.

Should liquid refrigerant enter the tank it is prevented from flowing through the oil return conduit by a liquid refrigerant sensor, which closes a solenoid valve positioned in the oil return line.

DETAILED DESCRIPTION OF THE INVENTION

Figure 1:
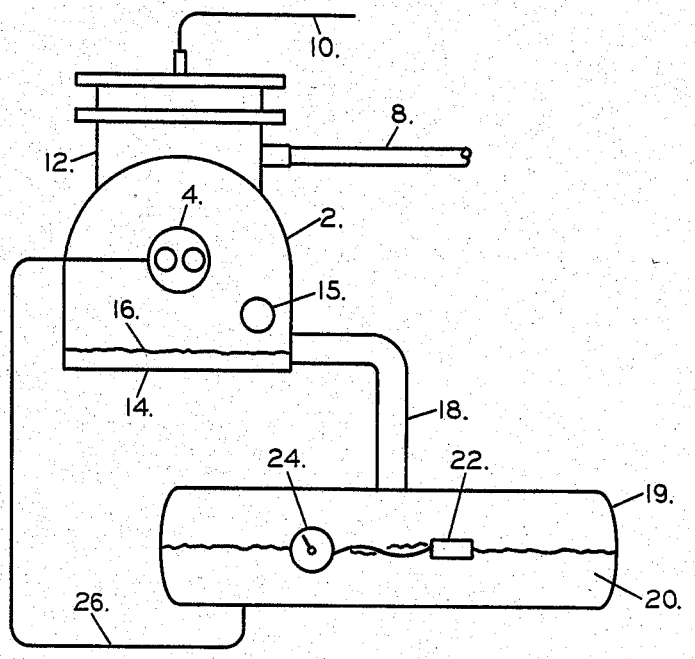
FIG. 1 shows the invention, including a compressor and an external oil reservoir, where the pump for transferring oil from the reservoir to the compressor is the oil pump integral with the compressor which is used to provide pressurized oil flow through its bearings.

FIG. 1 shows a compressor having crankcase 2, cylinder 12, having suction inlet 8 and discharge 10, an oil pump 4, so connected as to receive oil from oil reservoir 19 and discharge the oil to all the compressor bearings. After completing its lubricating and cooling function within the compressor bearings, the oil falls into the compressor sump 14 to form a pool 16. Overflow 18 is connected at or near the bottom of sump 14 so that oil collected in sump 14 overspills through conduit 18 into oil reservoir 19. Oil reservoir 19 contains therein a pool of oil 20. The level of the pool of oil is transmitted to the exterior of the oil reservoir by internal float 22, which communicates with an external dial 24 by a magnetic coupling. Oil pump 4 mounted on and driven by the compressor is connected to the bottom of reservoir 19 by conduit 26, whereby when the compressor 2 operates, oil pump 4 withdraws oil directly from the pool of oil 20 in the external oil reservoir 19, supplies it in pressurized condition to the compressor bearings from which the oil is emitted and falls to the floor of sump 14.

During the course of compressor operation, some of the oil traversing the compressor bearings is entrained in the refrigerant vapor flow stream traversing the compressor and leaves the compressor by discharge conduit 10. This same proportion of oil which is discharged with the vaporous refrigerant through conduit 10 is eventually received back to the compressor through suction conduit 8. Within the compressor are separator means, such as a motor compartment for separating oil from the suction vapor and causing the oil so separated to flow into the bottom of sump 14, where any excess of this oil overflows through the overflow conduit 18 into the reservoir 19.

Figure 2:
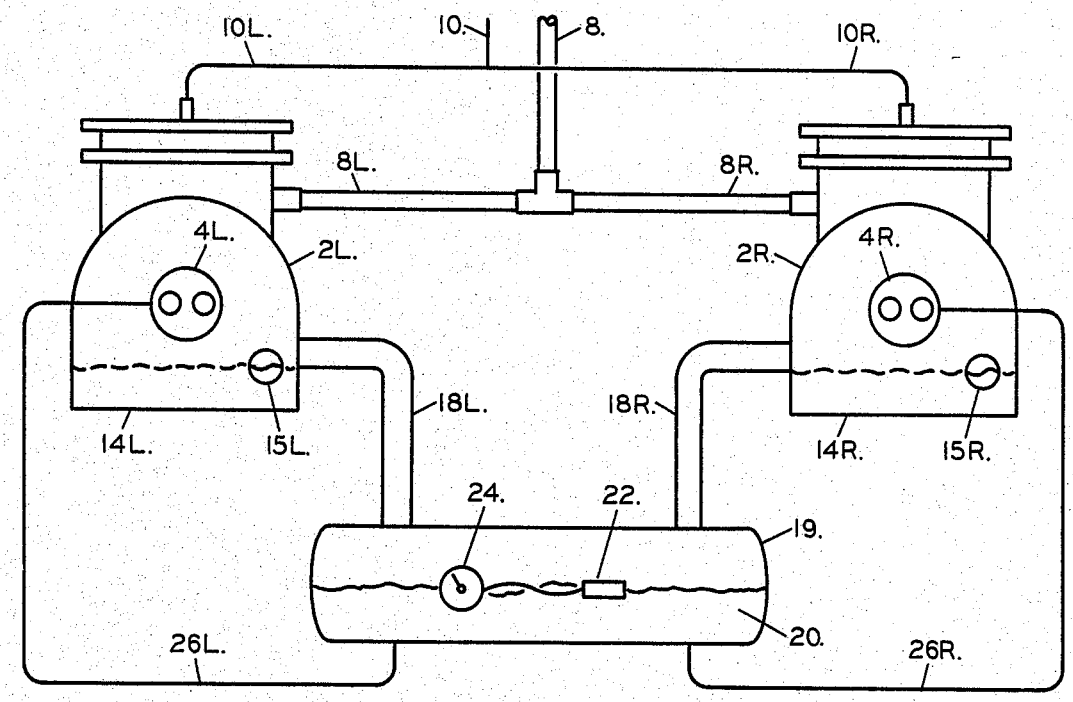
FIG. 2 shows two compressors operated in parallel utilizing a single oil reservoir at a source for both, where the pumps, mounted on each compressor for supplying pressurized oil to the compressor bearings, are the same pumps used for transferring oil from the reservoir to the compressors.

FIG. 2 utilizes the principle of the invention to solve a difficult problem in oil equalization between two compressors. The equalization of oil between two compressors when they both may be running or either one may be off while the other is running has proved to be an extremely difficult problem. To the day of my invention, the problem has not been completely and effectively solved. Current solutions include the use of a single, large equalizer between the two compressor sumps, mounted at the desired oil level; a large, upper equalizer, plus a smaller equalizer joining the compressor sumps below the oil level; no equalizer at all; and the ACR arrangement, which requires a discharge line oil separator, an oil reservoir maintained at a pressure higher than suction pressure by a pressure differential regulating valve, and one float for each of the compressors to be operated in parallel. Each float is connected to the oil reservoir by oil conduit. When the level in the compressor sump, monitored by a float, falls below the setting of the mechanism, the float causes an orifice to open, allowing oil to flow from the reservoir to the compressor. When the level of the oil in the compressor sump has risen above the setting of the mechanism, the float closes the orifice and stops the flow of oil from the reservoir to the compressor. The primary drawback of this arrangement, aside from the relatively high temperature of the oil delivered from the discharge drain to the reservoir and thence to the compressor, is the hazard that if any of the individual compressor floats stick open, then an excessive supply of oil will be supplied to the sump of that compressor, causing all of the difficulties which have in the past been related to an excessive supply of oil and which have been related above.

In the present invention the problem is solved by supplying an excess of oil to all the compressors connected and acting in parallel. Compressor 2L is supplied with oil from the common oil reservoir 19. Pump 4L of compressor 2L withdraws oil from the pool 20 and reservoir 19, through conduit 26L and delivers it directly to the compressor bearings. The excess oil is emitted from the compressor bearings, falls into the pool of oil residing in sump 14L, and overflows through conduit 18L into the reservoir 19. In like manner, in the righthand compressor 2R, oil pump 4R withdraws oil from pool 20 in common reservoir 19 and via conduit 26R transmits it to the bearings and journals of compressor 2R, from which the oil is emitted and falls into the pool of oil in the sump 14R of the righthand compressor. Excess oil simply overspills to overflow conduit 18R into the reservoir 19. Oil returning from the system through suction conduit 8 may be divided so as to flow to both the left and the right compressor or may all flow to one compressor through some idiosyncrasy of the piping. No harmful performance results, however, from poor distribution of the oil which is returned to main suction conduit 8 to the two compressors. This is because the compressor is already supplied with all the oil it needs and oil separated by each of the compressors from its individual suction stream is merely returned to the compressor sump and thence to the oil reservoir 19, where it is immediately available for re-use and re-distribution to all the compressors.

Figure 3:
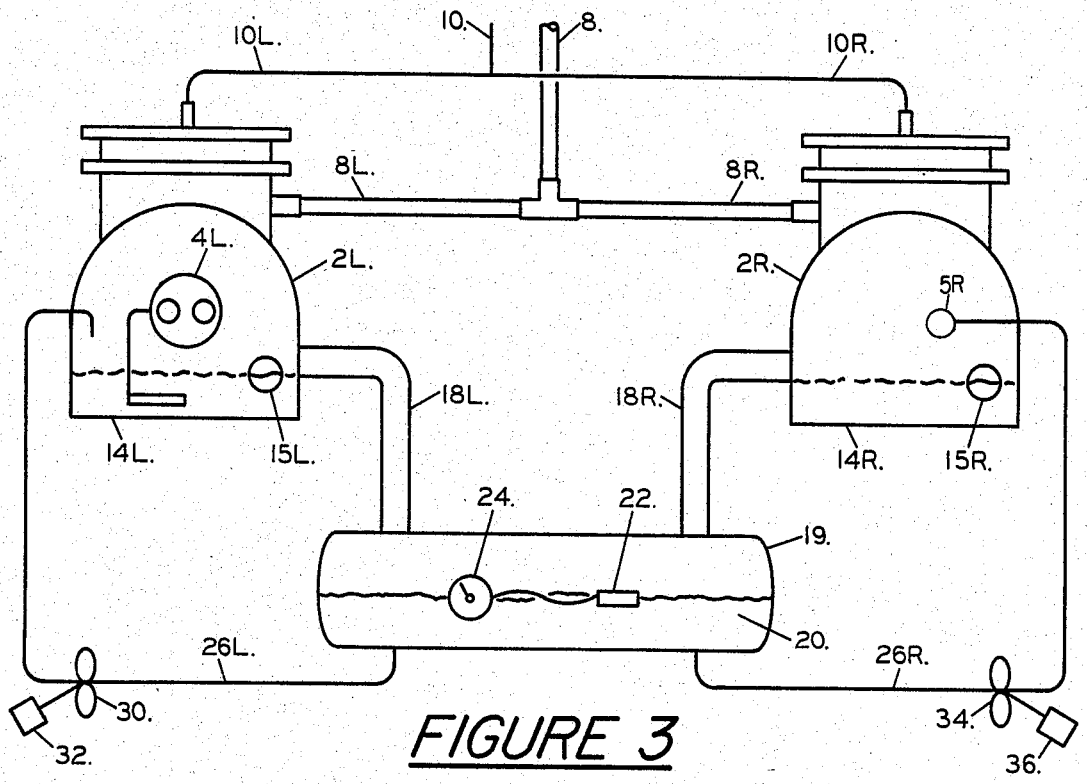
FIG. 3 shows two compressors, both supplied with oil from one oil reservoir, where separate external pumps are used to withdraw oil from the reservoir and transfer it in excess quantity to the compressor crankcase.

In FIG. 3 the individual oil sumps are maintained at a satisfactory full but not over-full level by the external oil pumps 30 and 34 driven respectively by motors 32 and 36 which draw oil from the common pool 20 in common oil reservoir 19 through conduits 26L and 26R and transfer the oil, in excess quantity to that required by any compressor, to the respective oil sumps 14L and 14R. The sump of the lefthand compressor is supplied directly be external pump 30 and the bearings of the lefthand compressor are supplied by pump 4L which draws its supply from sump 14L. In an alternate construction shown in the righthand compressor, the integral oil pump is omitted and pressure to the bearings is supplied directly by external pump 34. The excess oil emitted from the compressor bearings falls into the pool of oil residing in sump 14R. The excess oil transferred to these sumps simply overspills to conduits 18L and 18R back to the pool of oil 20 in oil reservoir 19. It is immaterial whether the pumps 30 and 34 are caused to run with their respective compressors or operate all the time. Even if the pressure in one of the compressor sumps is substantially higher than the pressure in another of the compressor sumps, the oil levels in the respective compressors will not change but will be maintained at or slightly above the minimum level of the overflow conduits 18L and 18R.

Figure 4:
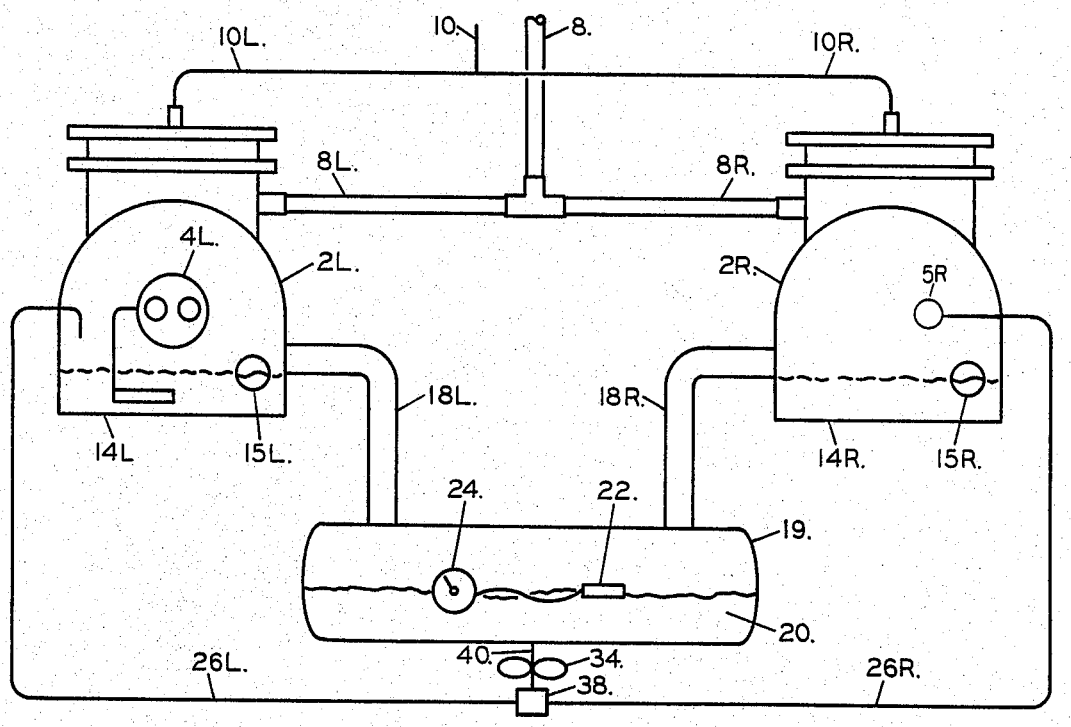
FIG. 4 shows two compressors utilizing a single oil reservoir, where a single pump is utilized to withdraw oil from the reservoir and deliver it to both compressors by way of a distributor that divides the oil stream discharged by the pump into two substantially equal flow streams.

FIG. 4 is similar to the construction of FIG. 3 except that a single pump 34 driven by an external motor is connected to withdraw all the necessary oil for the two compressors from pool 20 in oil reservoir 19. The excess quantity of oil delivered by pump 34 is divided into two substantially equal streams by distributor 38 and conveyed to the respective left-and righthand compressors to conduits 26L and 26R. Alternative constructions are displayed in the lefthand and righthand compressors. In the lefthand compressor oil supply line 26L delivers oil to the compressor sump 14L while the pressurized oil supply to the bearings is provided by pump 4L which is integral with the compressor. By contrast, in the righthand compressor there is no oil pump integral with the compressor. Instead, the bearings are supplied with pressurized oil by external pump 34 through distributor 38 and conduit 26R. Normally all compressors in a group will have their bearings lubricated in the same way, i.e., by either the lefthand or the righthand construction of FIG. 4.

Figure 5:
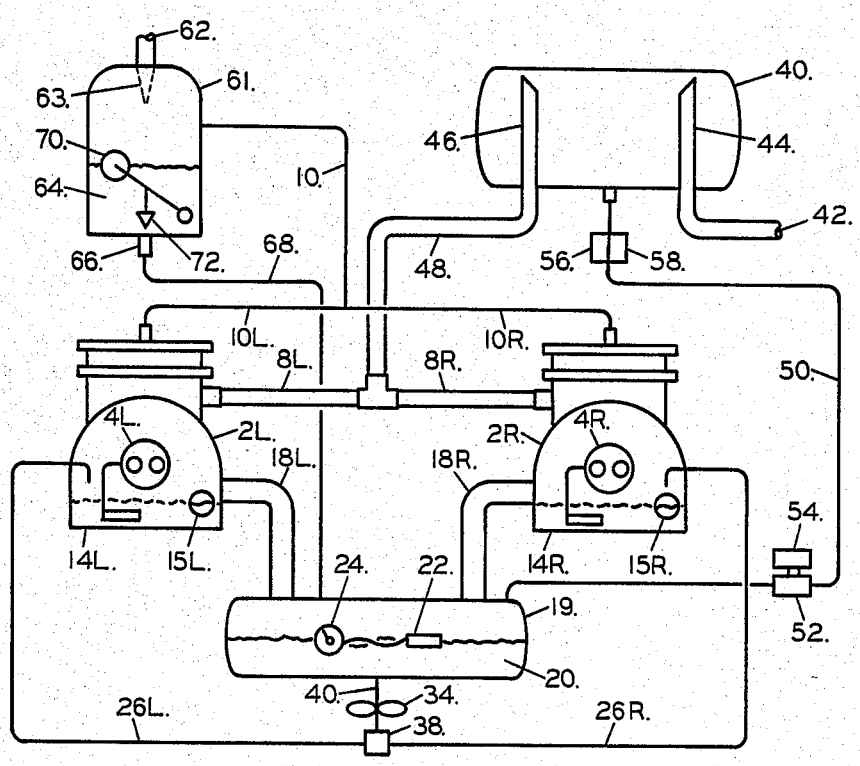
FIG. 5 is like FIG. 4, except that high side and external low side oil separators have been added. The system could operate properly with either one or both. The oil return line from the low side accumulator includes a solenoid valve and a liquid refrigerant detector.

FIG. 5 shows the same system as FIG. 4 with the addition of a discharge line oil separator 61, receiving discharge vapor from one or both of the compressors through conduit 10; a strainer 63 coalesces fine particles of oil suspended in the hot vapor streams which fall into pool 64 of oil residing in the bottom of the oil separator. The discharge vapor, cleansed of the entrained oil, flows out of the oil separator through conduit 62. When enough oil has been accumulated in oil separator 61 to raise the float 70, pin 72 lifted out of outlet port 66, allows hot oil to flow to conduit 68 back to the pool 20 in oil reservoir 19. When the level of the oil pool 64 in the oil separator 61 has been lowered sufficiently by this outflow to cause the level of float 70 to fall, then the pin 72 will close the outlet connection 66 as the oil separator and flow through the conduit 68 will stop.

Suction accumulator 40 installed in suction conduit 42/48 is employed primarily for the purpose of preventing liquid refrigerant entrained with the suction vapor leaving the evaporators from reaching the compressors and damaging them. However, the accumulator also performs the function of removing oil which is entrained with the suction vapor. In order to ensure that the oil is returned to the compressor, a conduit 50 is provided, connecting the bottom of accumulator 40 with oil reservoir 19. A solenoid valve 52, actuated by coil 54 is installed in oil return line 50 for a purpose to be explained hereafter. A liquid refrigerant detector, identified in FIG. 5 by numerals 56 and 58, is soldered to line 50. The details of the construction of the liquid detector are provided in FIGS. 6 and 7 and will be discussed later.

When oil only reaches the bottom of accumulator 40, it traverses the refrigerant liquid detector without affecting it and the liquid detector causes solenoid valve 52 to remain open. When liquid refrigerant reaches liquid detector 56/58, it responds within a few seconds, causing the solenoid valve 52 to close, preventing the liquid refrigerant from reaching the pool of oil 20 in oil reservoir 19.

Figure 6:
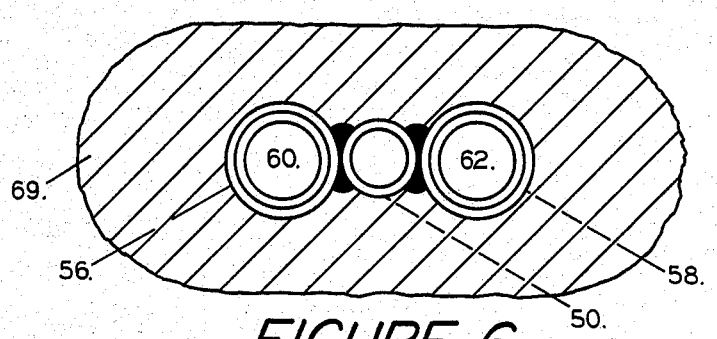
FIG. 6 is a cross section of the liquid refrigerant detector.
Figure 7:
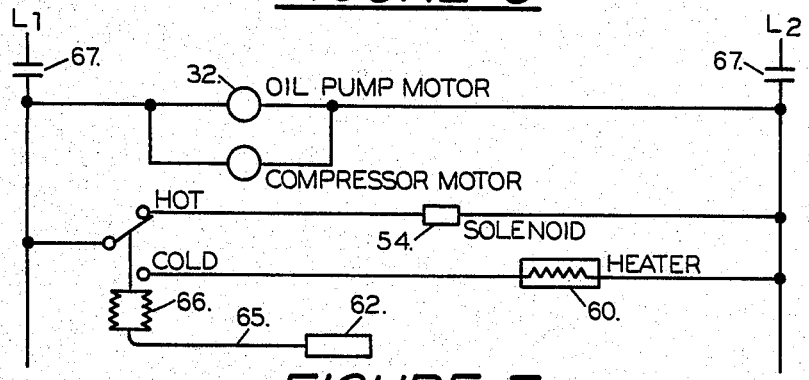
FIG. 7 is a wiring schematic for the invention including the liquid refrigerant detector.

FIG. 6 shows a cross section of tube 50 with two insert wells 56 and 58 soldered to it, one on either side. The entire assembly of tube 50, the insert wells and the contents of the insert wells are surrounded by a mass of insulation 69. Within well 56 is placed an electric cartridge heater 60. Typically this heater has a power dissipation of between 50 and 100 watts, with 75 watts being optimum. Thermostat bulb 62 resides in well 58. In FIG. 7 the thermostat 66 has contacts H and C. The H contact is closed when the bulb 62 of the thermostat is above its preset temperature. The contact C is closed when the bulb 62 is below the preset temperature of the thermostat. When the system is placed in operation and magnetic switches 66 close to cause the compressor motor to operate, the oil pump motor 32 also begins operation. At that time, if the thermostat is in the H position, then the coil 54 of the solenoid valve 52 is energized and the valve is open. Typically, the thermostat is set for 30° F. (−1° C.). If the assembly is situated outdoors and the temperature is below the setting of the thermostat, whether or not liquid refrigerant is present, the thermostat will be in the C position, at which time the solenoid coil 54 will be deenergized, the solenoid 52 will be closed, and the heater 60 will be energized. If there is no liquid present in conduit 50, the heater will readily cause the temperature of bulb 62 to rise to its setting, open the C and close the H contact, causing solenoid 54 to open. The insulation 69 will retain the heat and solenoid 52 will remain open for long periods. As soon as liquid refrigerant enters conduit 50, its boiling and chilling effect will cool bulb 62 below its setting of 30° and will prevent heat dissipated by heater 60 from reaching the bulb 62. The thermostat will open H contact and close C contact, thereby causing the heater to begin to attempt to boil away the liquid refrigerant residing in tube 50, at the same time de-energizing coil 54 of solenoid 32 and causing it to close.

When all the liquid refrigerant has been dissipated from drum 40 and from tube 50, the heater will again be able to warm bulb 62 and the closed contact will move from the C contact to the H contact, again causing the heater 60 to be deenergized and the solenoid 54 to be energized and open.

I claim:

1. An improved oil supply system for a refrigeration compressor, said compressor constituting means for causing motion in a high pressure gas stream leaving the compressor and a low pressure gas stream entering the compressor, said compressor having an oil sump; wherein the improvement comprises a. an oil reservoir having an oil zone and a vapor zone, said reservoir being positioned to receive gravity flow from the sump;
b. oil separator means for separating oil from a gas stream;
c. means for returning oil from the separator means to the reservoir;
d. flow means connecting a point in the reservoir oil zone and a point in the compressor;
e. pump means positioned in said flow means for conveying oil from the reservoir to the compressor; and
f. overflow conduit means for conveying excess oil from said sump to said reservoir.

2. A system as in claim 1 where the pump means is integral with the compressor.

3. A system as in claim 1 where the pump means is separate from the compressor.

4. A system as in claim 1 where the oil separator means is integral with the compressor.

5. A system as in claim 1 where the oil separator means is in the high pressure gas stream.

6. A system as in claim 1 where the oil separator means is in the low pressure gas stream.

7. A system as in claim 1 where the oil return means from the separator means to the reservoir includes the oil sump.

8. An improved oil supply system for a refrigeration compressor, said compressor constituting means for causing motion in a high pressure gas stream leaving the compressor and a low pressure gas stream entering the compressor, said compressor having an oil sump; wherein the improvement comprises a. an oil reservoir having an oil zone and a vapor zone, said reservoir being positioned to receive gravity flow from the sump;
b. oil separator means positioned in the low pressure gas stream for separating oil from said stream;
c. oil return means for returning oil from the separator means to the reservoir;
d. a solenoid valve positioned in the oil return means;
e. flow means connecting a point in the reservoir oil zone and a point in the compressor;
f. pump means positioned in said flow means for conveying oil from the reservoir to the compressor;
g. overflow conduit means for conveying excess oil from said sump to said reservoir; and
h. liquid refrigerant detecting means subject to the oil return means for closing the solenoid valve on the presence of liquid refrigerant in the oil return means and for opening the solenoid on the absence of liquid refrigerant in the oil return means.

9. A system as in claim 8 where the means for detecting liquid refrigerant constitutes a heater contacting the conduit of the oil return means at a point, and a thermostat having a setting, being positioned in contact with said conduit at an adjacent point, whereby in the presence of liquid refrigerant the thermostat will be cooled to a temperature below its setting and cause the solenoid valve to be closed, and in the absence of liquid refrigerant the thermostat will be heated to a temperature above its setting and the solenoid valve will be open.

10. An oil supply system for a refrigeration compressor having a sump, said system further comprising a. an oil reservoir having an oil zone and a vapor zone, said reservoir positioned to receive gravity flow from the sump;
b. flow means connecting a point in the reservoir oil zone and a point in the compressor;
c. pump means positioned in said flow means for conveying oil from the reservoir to the compressor; and
d. overflow conduit means for conveying excess oil from said sump to said reservoir by gravity.

11. A system as in claim 10 where the pump means is integral with the compressor.

12. A system as in claim 10 where the pump means is separate from the compressor.

13. In a refrigeration system having a compressor including a sump and an oil reservoir positioned to receive gravity flow from the sump, the method of controlling the oil level in the compressor comprising the steps of a. pumping oil from the reservoir to the compressor;
b. draining excess oil from the compressor back into the reservoir.

14. A method as in claim 13 where step a includes the step of pumping the oil to the compressor sump.

15. A method as in claim 13 where step a includes the step of pumping the oil to the compressor bearings.

16. An improved oil equalization system for at least two compressors having sumps, said system further comprising:

(a) an oil reservoir having a vapor zone and an oil zone positioned to receive gravity flow from the sumps;

(b) flow means connecting the oil zone and the compressors;

(c) pump means positioned in the flow means for pumping oil from the reservoir to the compressors;

(d) and overflow means for conveying excess oil from each compressor sump to the reservoir.

17. A system as in claim 16 where the pump means is integral with a compressor.

18. A system as in claim 17 where the pump means delivers oil directly to the compressor bearings.

19. A system as in claim 16 where the pump means is separate from a compressor.

20. A system as in claim 19 where the pump means delivers oil directly to the compressor bearings.

21. A system as in claim 16 where the pump means is singular and further including means for distributing oil from the pump to the compressors.

22. A system as in claim 21 where the pump means delivers oil directly to the compressor bearings.

23. A system as in claim 16 where the pump means delivers oil directly to the compressor bearings.

* * * * *